United States Patent [19]

Hellwig

[11] 4,277,963

[45] Jul. 14, 1981

[54] KEY LOOP

[75] Inventor: Oskar A. Hellwig, Springfield, Mass.

[73] Assignee: Beatrice Foods Co., Chicago, Ill.

[21] Appl. No.: 71,790

[22] Filed: Aug. 31, 1979

[51] Int. Cl.[3] ..... A47G 29/10

[52] U.S. Cl. ..... 70/456 B

[58] Field of Search ..... 70/456 B, 456 R, 457–459; 150/40; 24/3 K

[56] References Cited

U.S. PATENT DOCUMENTS

| | | | |
|---|---|---|---|
| 1,553,445 | 9/1925 | Holmes | 70/456 B |
| 3,485,070 | 12/1969 | Gleeson | 70/456 B |

FOREIGN PATENT DOCUMENTS

| | | | |
|---|---|---|---|
| 645606 | 11/1950 | United Kingdom | 70/456 B |

*Primary Examiner*—Robert L. Wolfe

*Attorney, Agent, or Firm*—Chapin, Neal & Dempsey

[57] ABSTRACT

A key loop for releasably supporting keys on the key head of a key case. The loop is of integral construction and formed of spring metal rod stock and includes an enlarged head for connecting the loop to the key head at the upper end of a shank portion which extends downwardly from the head. From the lower end of the shank, the key loop is reversably curved outwardly and upwardly with its free end terminating adjacent the inner surface of the shank at a substantial distance below the head. The free end of the key loop includes a retainer portion which extends inwardly and at least partially toward the lower end of the loop. The upper surface of said retainer portion and opposed portion of the shank provide an access opening for the apertured head of a key. The inner surface of said retainer portion serves to prevent inadvertent removal of a key from the loop.

3 Claims, 1 Drawing Figure

KEY LOOP

BACKGROUND

This invention relates to key loops such as those used in releasably supporting keys in depending relation from a key head affixed within various types of key cases. The type of key case typical of those to which the key loops of the present invention may be adapted is shown in U.S. Pat. Nos. 4,058,602 and 4,086,796.

Key support loops generally comprise a spring metal rod or wire stock formed into a loop with an access opening at the top. The loop may be a "tear drop" or "pear" shape with an enlarged head or ball for attachment to a key head or bar mounted across the inside top of the key case. The free end of the resilient loop terminates adjacent the shank portion thus forming an access opening or mouth adapted to receive a key which may be fitted onto the loop by inserting the apertured head of the key onto the free upper end of the loop and pressing downwardly to wedge open the mouth portion of the loop.

Those who are familiar with these types of key cases are aware that attachment of a key to a support loop usually requires a fair degree of care and dexterity. Even after careful attachment of the keys, however, it is not uncommon to find that one or more keys has become detached from such conventional key loops. This happens by the key head working its way toward the mouth of the key loop and wedging apart the mouth portion of the loop so that the key may become separated from the key case.

Prior art attempts to render key loops more secure from such key loop separation have involved the use of closure attachments for spanning the key receiving mouth portion of the loop. Another approach has been to provide key loops of relatively complex configuration in which the upper ends of the loop are of split construction and the loop is opened and closed by twisting its upper ends. It will be realized that the manufacture of such loop structures involve greater manufacturing time than a simple loop and are thus more costly. In addition, such loops must be removed from the key loop support bar in order to attach or remove a key therefrom.

It is a principal object of the present invention to provide a key hook which overcomes the deficiencies of the prior art.

Another object is to provide a key hook wherein the problem of accidental key detachment is essentially eliminated.

Yet another object of the present invention is to provide a key hook on which a key can be attached easily and conveniently.

It is a further object of the present invention to provide a key hook which is simple in construction and economical to manufacture.

SUMMARY OF THE INVENTION

These and other objects which will become more readily apparent from the following detailed description taken in connection with the accompanying drawings are attained by the key loop of the present invention which comprises a shank portion, an outer bight portion and an upwardly and inwardly turned outer leg portion which terminates adjacent the shank so as to form an access opening or mount for fitting key heads onto the loop. A ball or enlarged head is disposed on the upper end of the shank portion for attachment to a key loop support bar. The free end of the loop includes an inturned retainer portion which prevents a key head from wedging open the mouth of the key loop and thus prevents the key head being unintentionally separated from the key loop.

BRIEF DESCRIPTION OF THE PREFERRED EMBODIMENT

Figure 1:
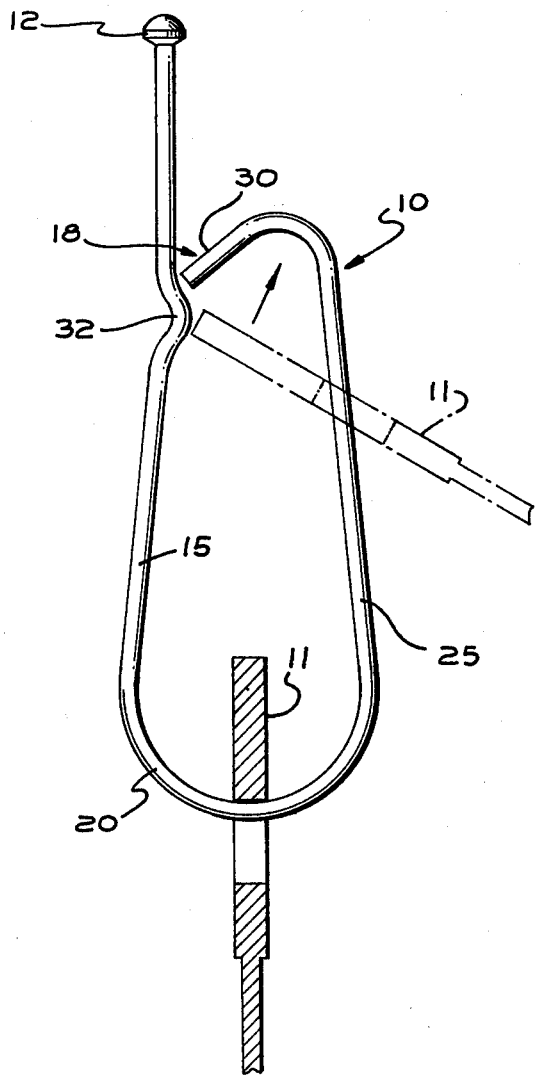
FIG. 1 is a front elevational view of the key hook of the present invention.

Referring to FIG. 1, the key loop of the present invention is shown generally at 10 and comprises an integral loop formed of a wire or rod stock of spring metal. The loop is open adjacent its upper end for the attachment and removal of keys having apertured heads such as shown at 11.

The loop comprises a ball of enlarged head 12 at the upper end by which the loop may be supported by a key loop support bar such as those disclosed for example in the above mentioned patents. From the head 12, the loop includes a shank portion 15 which extends downwardly from the head. From the lower end of the shank portion 15, the loop is reversibly turned outwardly and upwardly with its free end terminating adjacent the inner surface of the shank 15 a substantial distance from the ball 12, thereby forming an access opening or mouth 18. In the embodiment shown the outer end or bight portion 20 of the loop is curved to fair smoothly with the lower end of the rectilinear shank 15 and an upwardly extending rectilinear leg portion 25.

As shown, the leg 25 extends upwardly and converges with the shank 15 toward the mouth 18. The configuration of the loop is "pear shaped" with curved bight portion 20 forming the largest transverse dimension of the loop.

The upper end of leg 25 has an inturned terminal end which serves as a retainer portion 30 which extends inwardly and downwardly toward the lower end or bight portion of the loop. The upper surface of the retainer 30 and opposed surface portion of the shank provide a mouth or access opening 18 of tapered width to facilitate fitting of an apertured key head such as shown at 11 onto the leg portion 25 whereby the key may be dropped to the bottom of the loop or bight portion 20 where it is supported in depending relation. The inner surface of the retainer 30 serves to prevent inadvertent removal of the key from the loop.

As shown, shank portion 15 and leg 25 are generally rectilinear along the major portions of their lengths and are connected by smoothly curved bight portion 20 having a radius of curvature in the neighborhood of 5/32 inch. This geometry of bend 20 allows a key to smoothly traverse and hang freely from this portion for ease in assembly and use of the key with the hook.

The retainer portion 30 is defined by the terminal end of the leg 25 which is inturned toward the shank and bottom portion of the loop. The shank portion of hook 10 includes a crimp or detent 32 disposed slightly below the inner end of the retainer portion 30. The detent 32 serves to cam a key head under the retainer 30 rather than allowing the key head to wedge open the mouth of the loop so as to become separated from the loop. In other words, the retainer extends toward the interior of the loop and should the key head move toward the mouth of the loop it will be cammed under the retainer 30 and be held securely within the confines of the loop. This is to be distinguished from prior art key hooks wherein a similar outward movement of a key head often results in the key head wedging open the mouth of the loop with attendant risk of accidental separation of the key from the loop and key case. It will also be appreciated that the inward extension of the terminal finger eiliminates the risk of injury to one's fingers caused by the end of the wire leg when attaching or detaching a key.

A key may be attached to the loop 10 while the loop is attached by its head 12 to the key loop support bar within the key case. A key is inserted head down into the tapered gap between the upper surface of the retainer 30 and the shank 15, wedging apart these two portions. Continued downward movement of the key head 11 brings its aperture into alignment with the end of the retainer 30 whereupon the retainer will snap into the key aperture whereupon the key may be dropped downwardly on leg 25 thus being securely coupled on the loop. It will thus be appreciated that the mere insertion of the key itself causes the separation of the retainer 30 from shank 15 without necessitating any manipulation by the user of the key hook per se. It will thus be appreciated that the inclination of the retainer 30 provides a convenient lead-in for guiding the key head for coupling onto the loop.

A key may also be attached to the key loop 10 by first removing the loop from the key case and fitting a key over the head 12 and pressing the key head downwardly until it snaps past the end of the retainer 30 and crimp 32.

Having thus described the invention, what is claimed is:

1. Key loop for releasably mounting keys on a support member disposed within a key case comprising an integral resilient loop which includes an enlarged head for attachment of the loop to the support member, a shank portion extending downwardly from the head, said loop reversibly extending outwardly and upwardly from the lower end of said shank portion with its free end terminating adjacent the shank in spaced coplanar relation defining an access opening adapted for fitting the apertured head of a key onto the free end of said loop, at said free end a retainer portion extending inwardly and downwardly toward the closed end of said loop for preventing the unintentional separation of a key from the loop said shank portion including a crimp with its convex surface disposed within the loop and adjacent the free end retainer portion thereof.

2. Key loop as set forth in claim 1 wherein said loop is formed of a spring metal rod stock and wherein the closed end of said loop is a curved bight portion interconnecting the lower end of said shank portion and a leg portion which extends upwardly to said access opening.

3. Key loop according to claim 2 wherein the shank portion and leg portion are generally rectilinear and said bight portion is curvilinear, the upper surface of said retainer portion being inclined toward said shank portion providing a tapered guide surface to facilitate fitting a key head onto said key loop.

* * * * *